US011802680B2

(12) United States Patent
Kearns

(10) Patent No.: US 11,802,680 B2
(45) Date of Patent: Oct. 31, 2023

(54) WEARABLE ILLUMINATING DEVICE

(71) Applicant: Chris Kearns, Phoenix, AZ (US)

(72) Inventor: Chris Kearns, Phoenix, AZ (US)

( * ) Notice: Subject to any disclaimer, the term of this patent is extended or adjusted under 35 U.S.C. 154(b) by 306 days.

(21) Appl. No.: 16/983,031

(22) Filed: Aug. 3, 2020

(65) Prior Publication Data

US 2022/0034490 A1 Feb. 3, 2022

(51) Int. Cl.

| | |
|---|---|
| ***F21V 21/08*** | (2006.01) |
| ***F21V 23/04*** | (2006.01) |
| ***F21V 23/06*** | (2006.01) |
| ***F21V 21/096*** | (2006.01) |
| ***F21V 21/02*** | (2006.01) |
| *F21Y 107/30* | (2016.01) |

(52) U.S. Cl.

CPC ..... *F21V 21/0816* (2013.01); *F21V 21/02* (2013.01); *F21V 21/0832* (2013.01); *F21V 21/096* (2013.01); *F21V 23/04* (2013.01); *F21V 23/06* (2013.01); *F21Y 2107/30* (2016.08)

(58) Field of Classification Search

CPC ..... A47F 7/02; A45C 11/16; F21V 21/0816; F21V 23/06; F21V 21/02; F21V 23/04; F21V 21/0832; F21V 21/096; F21Y 2107/30

See application file for complete search history.

(56) References Cited

U.S. PATENT DOCUMENTS

| | | | | |
|---|---|---|---|---|
| 2,118,507 | A * | 5/1938 | Guttman | A47F 7/03 248/116 |
| 3,112,889 | A * | 12/1963 | Marmo | F21V 23/0414 362/103 |
| 3,944,803 | A * | 3/1976 | Chao | A01K 27/006 362/108 |
| 4,521,832 | A * | 6/1985 | Barbour | F21L 4/00 200/60 |
| 4,672,515 | A * | 6/1987 | Baker | F21L 14/02 24/20 LS |
| 5,154,506 | A * | 10/1992 | Leard | F21L 15/14 224/222 |
| 6,213,619 | B1 | 4/2001 | Yu | |
| D596,325 | S * | 7/2009 | Barbour | F21L 4/00 D26/39 |
| 3,550,648 | A1 | 10/2013 | Smith | |
| 9,752,762 | B1 * | 9/2017 | Poe, III | F21V 21/0832 |
| 2005/0124945 | A1 * | 6/2005 | Powers | A47K 5/122 604/310 |

(Continued)

*Primary Examiner* — Fatima N Farokhrooz
(74) *Attorney, Agent, or Firm* — Argus Intellectual Enterprise; Daniel Enea; Jordan Sworen

(57) ABSTRACT

A wearable illuminating device is provided. The wearable illuminating device includes a band having a first end and a second end, wherein the ends can removably couple via a band fastener to secure the band to a wrist of a wearer. In a closed configuration, the ends are coupled together forming a closed loop sized to receive the wrist of the wearer. A plurality of light sources is positioned about the band and each light source is able to emit light from a forward end. In this way, the wearable illuminating device frees up the wearer's hand to perform a task more adequately. Moreover, a forward end of each light source extends past a forward edge of the band, wherein an uninterrupted ray of light is emitted therefrom and is made to illuminate an object, free from an umbra or shadow generated by the plurality of light source.

4 Claims, 4 Drawing Sheets

(56) References Cited

U.S. PATENT DOCUMENTS

| | | | | |
|---|---|---|---|---|
| 2005/0269216 | A1* | 12/2005 | Ovadia | A47F 7/02 206/6.1 |
| 2011/0182057 | A1* | 7/2011 | Watson | F21L 4/027 362/103 |
| 2011/0310592 | A1* | 12/2011 | Smith | F21V 21/0816 362/103 |
| 2014/0043794 | A1 | 2/2014 | Carriere | |
| 2018/0100646 | A1 | 4/2018 | Sullivan | |
| 2020/0093287 | A1* | 3/2020 | Bourdignon | A47F 7/022 |
| 2020/0248896 | A1* | 8/2020 | Gall | F21L 4/04 |

* cited by examiner

WEARABLE ILLUMINATING DEVICE

BACKGROUND OF THE INVENTION

The present invention relates to a wearable illuminating device. More specifically, the present invention provides a device with forward facing lights that can be secured to a wrist or a mounting support, which in turn is mountable to a surface for illumination.

When performing manual tasks, it is important to have proper lighting. Oftentimes, situations arise in which a manual task must be performed in a dark or dimly lit setting, such as under a car or in a basement. To ensure a task is correctly and thoroughly completed, the environment surrounding the task must be fully illuminated and examined. In settings with poor lighting, flashlights or other illumination devices are often used. These devices restrict the mobility of the hands as they require the user to hold and point the light. This may result in the user having to perform their task with one hand, first examine the task while its illuminated and then attempt to perform the work needed without the aid of the light, or find an uncomfortable position to hold the light in to free up their hands, such as in one's mouth.

To make such tasks easier to perform and better illuminate the workspace, there exist light devices that can be attached to one's wrist. These devices include a wristband with one or more lights disposed around its exterior side that can be illuminated to provide light while performing a task. These wrist attachments free up one's hands to perform a task more adequately. These known devices are restricted in their versatility as their sole purpose is to attach to the user's wrist. Further, the position of the lighting element about the wristband on these known devices prohibit the amount of light emitted therefrom.

The present invention comprises a wrist lighting device with forward-facing lights to illuminate the user's hands. The present invention differs from the known art in that the present invention includes lights located parallel to one another along the band in cylindrical housings. Furthermore, the present invention includes a mounting support having a fastener, such as a magnet, for cooperatively securing the wristband and mounting support to an alternate surface for illumination. This device allows for proper lighting when performing poorly lit tasks while simultaneously keeping the user's hands free.

In light of the devices disclosed in the known art, it is submitted that the present invention substantially diverges in design elements from the known art and consequently it is clear that there is a need in the art for an improvement to existing wrist light devices. In this regard the instant invention substantially fulfills these needs.

SUMMARY OF THE INVENTION

In view of the foregoing disadvantages inherent in the known types of flashlights now present in the known art, the present invention provides a new wearable illuminating device wherein the same can be utilized for illuminating and viewing a target without holding the device.

It is an objective of the present invention to provide a wearable illuminating device that is removably securable to a wrist of a wearer, such that a plurality of lights illuminates a target area without requiring the holding of the device.

It is another objective of the present invention to provide the wearable illuminating device wherein the forward end of each light source extends past a forward edge of the band, wherein an uninterrupted ray of light is emitted therefrom and is made to illuminate an object, free from an umbra or shadow generated by the plurality of light source.

It is yet another objective of the present invention to provide the wearable illuminating device further comprising a mounting support, the mounting support comprising a first side having raised central disk and an annular shoulder therearound, wherein the central disk forms a sidewall therearound, wherein the mounting support is sized to receive the band in a closed configuration around the central disk abutting the sidewall and the shoulder.

It is therefore an object of the present invention to provide a new and improved wearable illuminating device that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

DETAILED DESCRIPTION OF THE INVENTION

Figure 1:
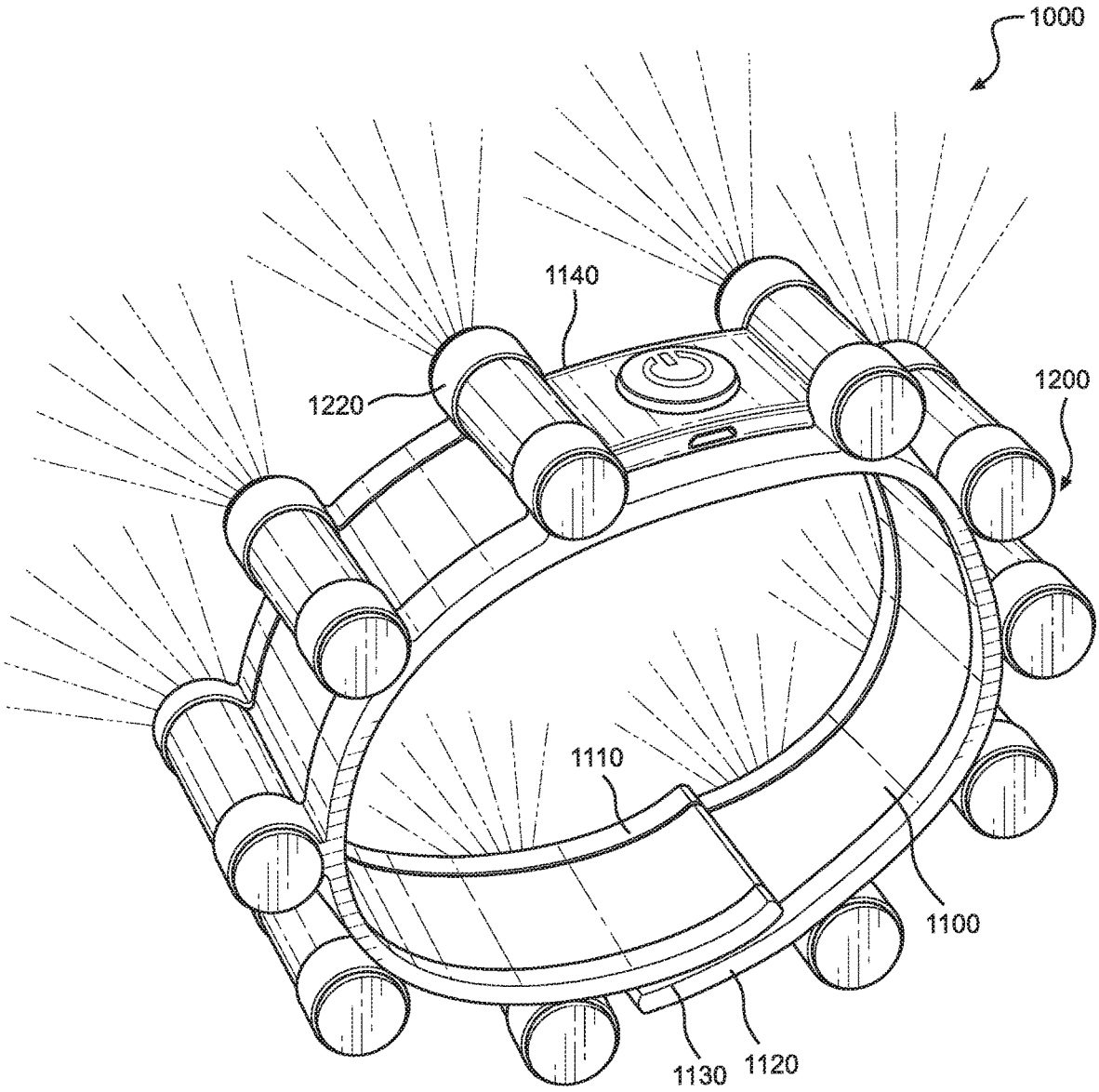
FIG. 1 shows a perspective view of one embodiment of the wearable illuminating device.

Reference is made herein to the attached drawings. Like reference numerals are used throughout the drawings to depict like or similar elements of the wearable illuminating device. For the purposes of presenting a brief and clear description of the present invention, the preferred embodiment will be discussed as used for illuminating and viewing an object or target in a generally hard to access location, to illuminate the object, free from an umbra or shadow generated by the wearable illuminating device and without the need to hold the device in a user's hand. The figures are intended for representative purposes only and should not be considered to be limiting in any respect.

Figure 2:
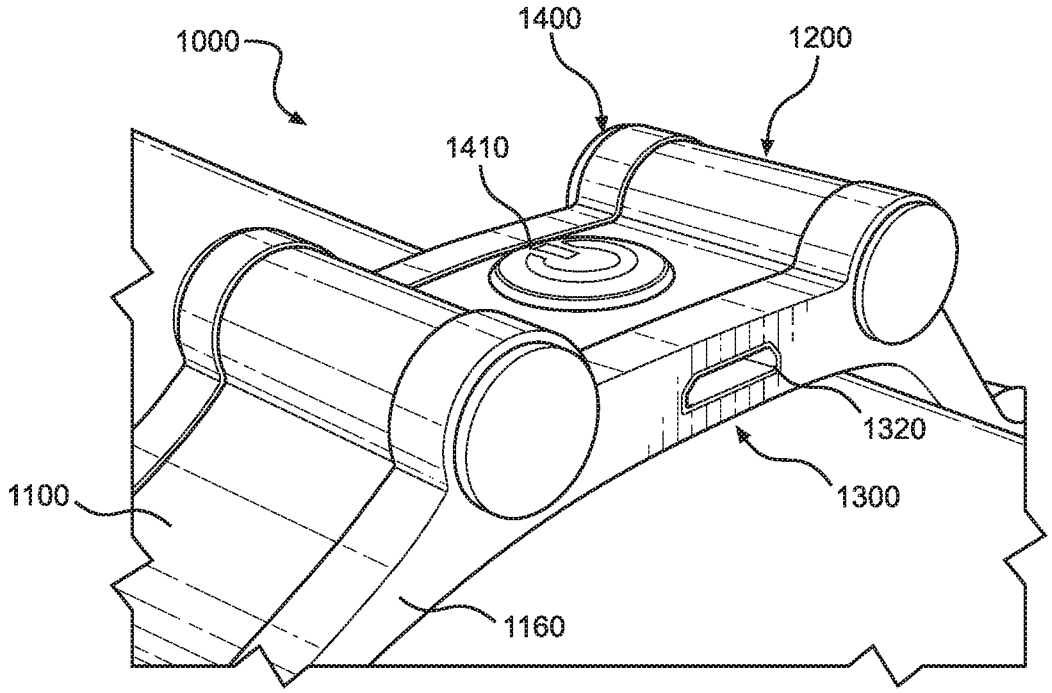
FIG. 2 shows a close-up view of one embodiment of the wearable illuminating device.

Referring now to FIGS. 1 and 2, there is shown a perspective view of one embodiment of the wearable illuminating device and a close-up view of one embodiment of the wearable illuminating device, respectively. The wearable illuminating device 1000 provides a device that is selectively activated and targeted to an object for illumination. The wearable illuminating device 1000 comprises a band 1100 having a first end 1110 and a second end 1120, wherein the ends 1110, 1120 are cooperatively adapted to removably couple and transition between an open configuration and a closed configuration via a band fastener 1130. In the closed configuration (as shown in FIG. 1), the ends 1110, 1120 are coupled together forming a closed loop sized to receive a wrist of a user therein. In this way, the wearable illuminating device 1000 is easily donned and doffed from the wrist of the wearer. In alternative embodiments, the wearable illuminating device 1000 is adapted to be secured to other limbs or portions of limbs. For example, the wearable illuminating device 1000 may be secured to the upper arm portion or secured to an ankle.

In one embodiment, the band fastener 1130 comprises mating hook and loop fasteners. In other embodiments, the band fastener 1130 may include a snap fastener, a quick release fastener, a magnetic fastener, and the like.

In the shown embodiment, the wearable illuminating device 1000 further includes a plurality of light sources 1200 disposed about the band 1100, wherein each light source 1200 is adapted to emit light from a forward end 1220 of the light source 1200. A forward end 1220 of each light source 1200 extends past a forward edge 1140 of the band 1100, wherein an uninterrupted ray of light is emitted therefrom and is made to illuminate an object, free from an umbra or shadow generated by the plurality of light source 1200. In this way, the wearable illuminating device 1000 clearly illuminates a desired target without the formation of shadows at the target area generated by the device 1000.

Referring specifically to FIG. 2, the wearable illuminating device 1000 includes an electrical circuit 1300 disposed within the band and 1100 operably connected to the plurality of light sources 1200 having a switch assembly 1400 for controlling the plurality of light sources 1200. The electrical circuit 1300 comprises a port 1320 adapted to receive an electrical connector to provide electrical power to a power source 1340 (shown in FIG. 3) of the band 1100. In some embodiments, the power source 1340 includes a rechargeable battery. The battery may include electrical storage capacity to provide power to the device 1000 for two to four hours in one embodiment. In one embodiment, the battery power source 1340 is removable therefrom and interchangeable with a second battery having compatible electrical properties. In one embodiment, the switch assembly 1400 comprises a toggle switch 1410 adapted to activate and deactivate the plurality of lights 1200.

In one embodiment, the toggle switch 1410 transitions between a first "on" state and an "off" state of the lights 1200. In an alternative embodiment, the toggle switch 1410 is also adapted to control the illumination intensity of the plurality of lights. In the illustrated embodiment, the toggle switch 1410 is positioned on the exterior side of the band between a pair of adjacent lights 1200. In this way, the switch can be easily accessed and is readily visible while on the user's wrist. As shown in FIG. 2, the port 1320 is positioned on a rearward edge 1160 of the band 1100. In this way, the wearable illuminating device 1000 may be secured to the wrist of the wearer and provide access to the port 1320 for charging thereof. The toggle switch 1410 can also serve as an indicator to the user for placement and alignment of the port 1320 relative thereto. In the illustrated embodiment, the port 1320 is positioned along an adjacent wall and directly aligned with the toggle switch 1410. For example, the toggle switch if placed on top of the wrist and aligned with back of the hand of the user, indicates to the user the alignment of the charging port 1320. This would allow a user to easily find the port 1320 if the wearable illuminating device needed charging in a dimly lit environment. In one embodiment, the port 1320 is positioned on the forward edge, the exterior side of the band 1100, or the interior side of the band 1100.

Figure 3:
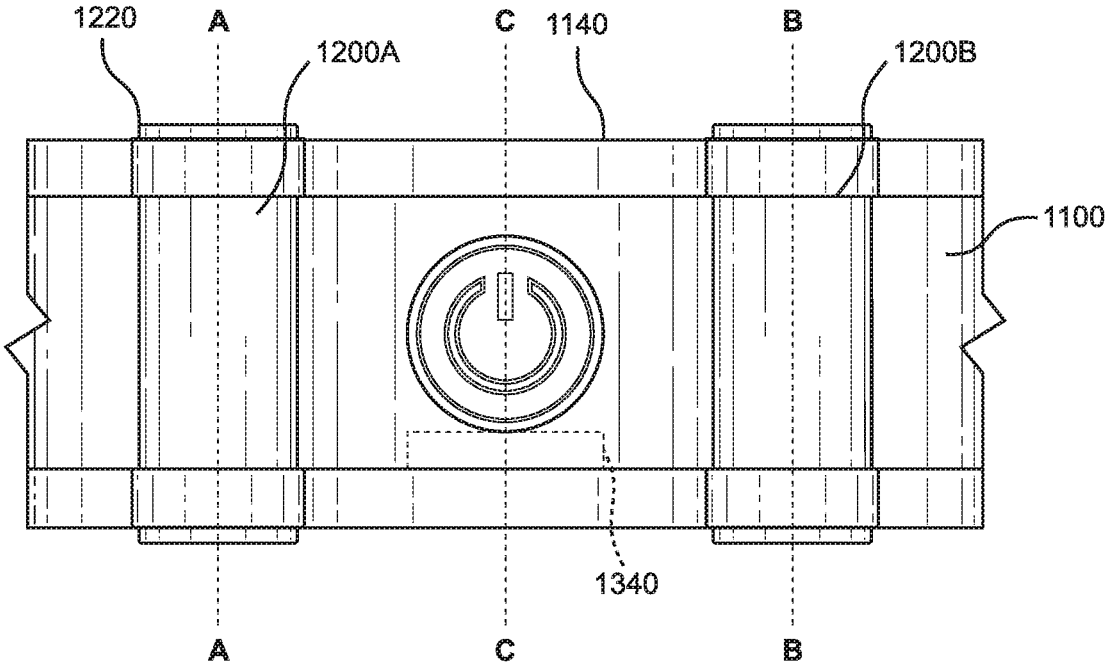
FIG. 3 shows a top plan view of one embodiment of the wearable illuminating device.

Referring now to FIG. 3, there is shown a top plan view of one embodiment of the wearable illuminating device. In the shown embodiment, each light source of the plurality of light sources 1200 comprise a cylinder housing 1200A, 1200B. The housings 1200A, 1200B are positioned around an exterior side of the band 1100 and at fixed intervals from each adjacent housings 1200A, 1200B. Additionally, each light source housing 1200A, 1200B is oriented parallel to each adjacent light source housing 1200A, 1200B along a first axis A-A and a second axis B-B respectively, wherein the first axis A-A and the second axis B-B are parallel to an axis of the closed loop C-C. The rounded exterior shape of the lights 1200 provide for additional comfort and safety while in use. In some instances, if the wearable illuminating device were to contact another person or the user other than the location where worn, the user or other person would not be exposed to sharp edges or corners.

In the shown embodiment, each light source housing 1200A, 1200B is adapted to emit light from a forward end 1220 of the light source 1200. The forward end 1220 of each light source housing 1200A, 1200B extends past the forward edge 1140 of the band 1100, wherein an uninterrupted ray of light is emitted therefrom and is made to illuminate an object, free from an umbra or shadow generated by the plurality of light source 1200. In one embodiment, the toggle switch 1410 is positioned on the band 1100 and equidistant the two adjacent light housings 1200A, 1200B.

Figure 4:
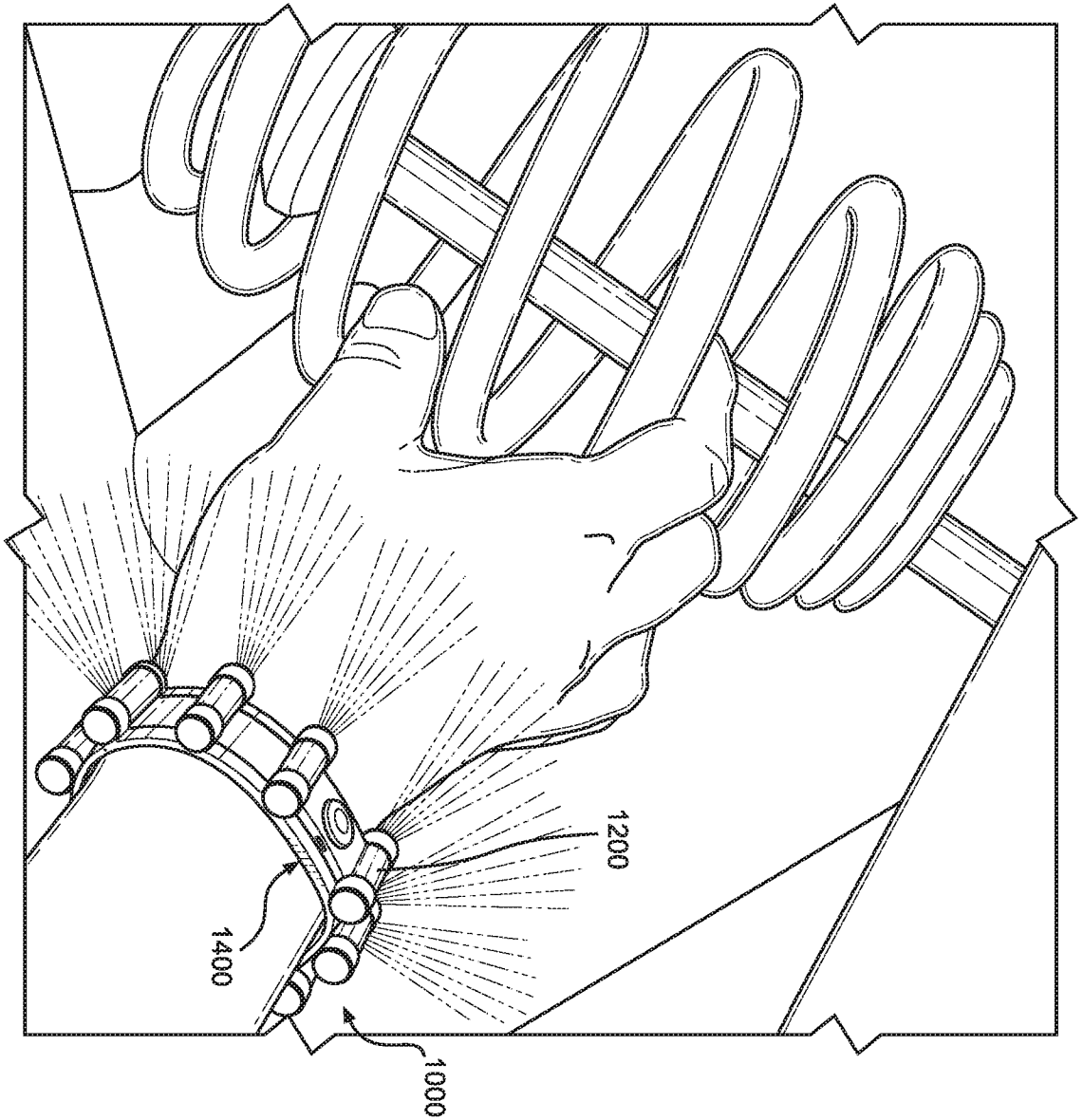
FIG. 4 shows an in-use view of one embodiment of the wearable illuminating device.

Referring now to FIG. 4, there is shown an in-use view of one embodiment of the wearable illuminating device. In the show embodiment, the wearable illuminating device 1000 is secured to a wrist of a wearer such that the lights 1200 are forward facing and away from the body of the wearer. The wearer may control the plurality of lights 1200 via the switch assembly 1400 to provide illumination to a target area. When secured to the wrist of a first arm, the wearer is free to handle and manipulate objects with the same first arm without requiring the holding of the wearable illuminating device 1000. Moreover, the lights 1200 provides unobstructed illumination of the target.

Figure 5:
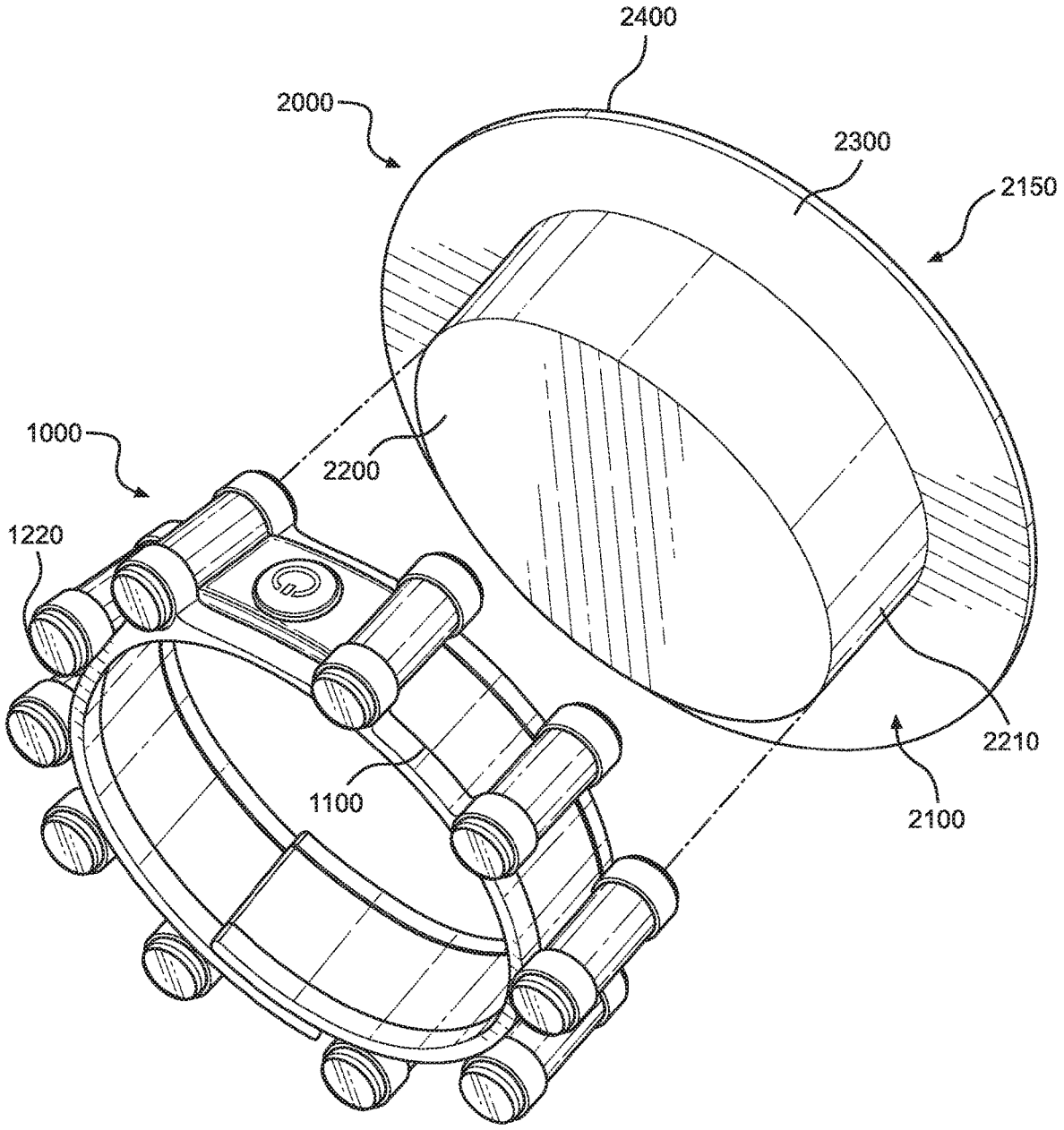
FIG. 5 shows an exploded view of one embodiment of the wearable illuminating device mounting to one embodiment of the mounting support.

Referring now to FIG. 5, there is shown an exploded view of one embodiment of the wearable illuminating device mounting to one embodiment of the mounting support. In the shown embodiment, the mounting support 2000 comprises a first side 2100 having raised central disk 2200 and an annular shoulder 2300 therearound. The central disk 2200 forms a sidewall 2210 therearound and extends upwards from the annular shoulder 2300 on the first side 2100. In the shown embodiment, the sidewall 2210 forms a smooth curved surface. The raised central disk 2200 has a circular top plane view and is positioned central to the mounting support 2000. The mounting support 2000 is sized to receive the band 1100 in a closed configuration around the central disk 2200 such that the band 1100 abuts the sidewall 2210 and the shoulder 2300. In this way, the band 1100 may be selectively closed around the disk 2200 to frictionally secure the band 1100 to the mounting support 2000. In the shown embodiment, the forward end 1220 of the plurality of lights are directed away from the first side 2100. Alternatively, the wearable illuminating device 1000 may be secured in a reverse position, such that the forward end 1220 of the plurality of lights are resting on the annular shoulder 2300. In one embodiment, the mounting support 2000 includes a securement fastener for otherwise securing the wearable illuminating device 1000 thereto.

In the shown embodiment, a second side 2150 of the mounting support 2000, the second side 2150 being opposite the first side 2100, comprises a fastener 2400 for cooperatively securing the mounting support 2000 and the wearable illuminating device 1000 to a surface, such as a wall or underside of a hood. In one embodiment, the fastener 2400 comprises a magnetic fastener. The fastener 2400 may include, but is not limited to, a hook and loop fastener, a snap fastener, and/or adhesive.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wearable illuminating device, comprising:

a band having a first end and a second end, wherein the ends are adapted to removably couple and transition between an open configuration and a closed configuration via a band fastener, wherein the closed configuration the ends are coupled together forming a closed loop sized to receive a wrist of a user therein;

a plurality of light sources disposed about the band, wherein each light source is adapted to emit light from a forward end thereof;

wherein the forward end of each light source extends past a forward edge of the band, wherein an uninterrupted ray of light is emitted therefrom and is made to illuminate an object, free from an umbra or shadow generated by the plurality of light source;

an electrical circuit operably connected to the plurality of light sources having a switch assembly for controlling the plurality of light sources;

wherein each light source is positioned around an exterior side of the band and at fixed intervals from an adjacent light source, such that the plurality of light sources are disposed entirely around the band in the closed configuration, resulting in the illumination the object, free from the umbra or shadow generated by the plurality of light source.

2. The wearable illuminating device of claim 1, wherein the fastener comprises a magnetic fastener.

3. The wearable illuminating device of claim 1, wherein a rear side of each of the plurality of lights are adapted to engage the first side of the mounting support.

4. The wearable illuminating device of claim 1, wherein the fastener comprises an adhesive or a suction cup.

* * * * *